US010460901B2

(12) United States Patent
Kruse

(10) Patent No.: US 10,460,901 B2
(45) Date of Patent: Oct. 29, 2019

(54) COOLING SPIRAL GROOVE BEARING ASSEMBLY

(71) Applicant: General Electric Company, Schenectady, NY (US)

(72) Inventor: Kevin Shane Kruse, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 222 days.

(21) Appl. No.: 15/720,024

(22) Filed: Sep. 29, 2017

(65) Prior Publication Data

US 2019/0103244 A1 Apr. 4, 2019

(51) Int. Cl.
*H01J 35/10* (2006.01)

(52) U.S. Cl.
CPC ..... *H01J 35/106* (2013.01); *H01J 35/101* (2013.01); *H01J 2235/1204* (2013.01); *H01J 2235/1262* (2013.01)

(58) Field of Classification Search
CPC ..... H01J 35/106; H01J 35/101
See application file for complete search history.

(56) References Cited

U.S. PATENT DOCUMENTS 6,477,236 B1 11/2002 Anno et al.
2009/0245469 A1* 10/2009 Ito ..... H01J 35/101 378/133
2016/0047415 A1* 2/2016 Hunt ..... F16C 33/1065 378/133
2017/0102031 A1* 4/2017 Potze ..... F16C 33/24
2018/0270939 A1* 9/2018 Proksa ..... A61B 6/40

* cited by examiner

*Primary Examiner* — Yara B Green
(74) *Attorney, Agent, or Firm* — Boyle Fredrickson, S.C.

(57) ABSTRACT

A liquid metal or spiral groove bearing structure for an x-ray tube and associated process for manufacturing the bearing structure is provided that includes a bearing shaft rotatably disposed in a bearing housing or shell. The shell includes a thrust seal engaged with a sleeve to maintain co-axiality for the rotating liquid metal seal formed in the shell about the shaft. The shaft has a bore for the introduction of a cooling fluid into the bearing assembly in which is disposed a cooling tube. The cooling tube includes turbulence-inducing features to increase the turbulence of the cooling fluid flowing through the cooling tube, consequently enhancing the heat exchange between the cooling fluid and the shaft. This maximizes the heat transfer from the shaft to the oil, allowing materials with lower thermal conductivities, such as non-refractory materials, to be used to form the bearing shaft and shell.

20 Claims, 5 Drawing Sheets

COOLING SPIRAL GROOVE BEARING ASSEMBLY

BACKGROUND OF THE INVENTION

The invention relates generally to x-ray tubes, and more particularly to structures and methods of assembly for the spiral groove bearing (SGB) utilized in an x-ray tube.

X-ray systems may include an x-ray tube, a detector, and a support structure for the x-ray tube and the detector. In operation, an imaging table, on which an object is positioned, may be located between the x-ray tube and the detector. The x-ray tube typically emits radiation, such as x-rays, toward the object. The radiation passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. The object may include, but is not limited to, a patient in a medical imaging procedure and an inanimate object as in, for instance, a package in an x-ray scanner or computed tomography (CT) package scanner.

X-ray tubes include a cathode and an anode located within a high-vacuum environment. In many configurations, the anode structure is supported by a liquid metal bearing structure, e.g., a spiral groove bearing (SGB) structure, formed with a support shaft disposed within a sleeve or shell to which the anode is attached and that rotates around the support shaft. The spiral groove bearing structure also includes spiral or helical grooves on various surfaces of the sleeve or shell that serve to take up the radial and axial forces acting on the sleeve as it rotates around the support shaft.

Typically, an induction motor is employed to rotate the anode, the induction motor having a cylindrical rotor built into an axle formed at least partially of the sleeve that supports the anode target and an iron stator structure with copper windings that surrounds an elongated neck of the x-ray tube. The rotor of the rotating anode assembly is driven by the stator. The x-ray tube cathode provides a focused electron beam that is accelerated across an anode-to-cathode vacuum gap and produces x-rays upon impact with the anode. Because of the high temperatures generated when the electron beam strikes the target, it is necessary to rotate the anode assembly at high rotational speed. This places stringent demands on the bearings and the material forming the anode structure, i.e., the anode target and the shaft supporting the target.

Advantages of liquid metal bearings such as spiral groove bearings in x-ray tubes include a high load capability and a high heat transfer capability due to an increased amount of contact area. Other advantages include low acoustic noise operation as is commonly understood in the art. Gallium, indium, or tin alloys are typically used as the liquid metal in the bearing structure, as they tend to be liquid at room temperature and have adequately low vapor pressure, at operating temperatures, to meet the rigorous high vacuum requirements of an x-ray tube. However, liquid metals tend to be highly reactive and corrosive. Thus, a base metal that is resistant to such corrosion is desirable for the components that come into contact with the liquid metal bearing, such as the shaft of the anode assembly and is rotated for the purpose of distributing the heat generated at a focal spot.

As a result, the structure of the sleeve to which the anode is connected and the support shaft must be capable of withstanding the high temperatures and mechanical stresses created within the x-ray tube, as well as be able to withstand the corrosive effects of the liquid metal bearing. As such, a refractory metal such as molybdenum or tungsten is typically used as the base material for the construction of the sleeve or shell as well as for the other bearing components. Not only are such materials resistant to corrosion and high temperatures, but they tend to be vacuum-compatible and thus lend themselves to an x-ray tube application. In addition, cooling of the bearing structure can be effected by flowing a cooling fluid into the center of the support shaft to thermally contact the heat taken from the anode by the sleeve and liquid metal bearing fluid.

However, as the refractory materials are difficult to machine, these surfaces are hard to manufacture without surface imperfections that enable leaks to occur in the seals. Also, due to the low galling/wear properties of the refractory materials, these surface imperfections, even if not present after machining, can occur during normal use of the tube resulting in the formation of fluid leaks, thereby shortening the useful life of the tube.

In an alternative construction for a liquid metal/spiral groove bearing structure, other metals, such as steel, can be utilized in place of the refractory metals for the construction of the sleeve and support shaft, such as disclosed in U.S. Pat. No. 6,477,236. While these other metals have a lower thermal conductivity, they have the benefits of low cost compared to the refractory metals, good machinability, good galling/wear characteristics, and good weldability. In particular, steel is a potential journal bearing material in x-ray tubes as it has better wear resistance compared to molybdenum. As such, these metals can be more easily constructed and joined to form the bearing sleeve.

However, one drawback to steel is that it has a much lower thermal conductance and a higher coefficient of thermal expansion compared to molybdenum. Therefore the steel is more prone to thermal gradients and resulting non-uniform bearing deflections, which can lower bearing load carrying capability. As a result of the decreased thermal conductivity, in prior art bearing structures, an oil cooling tube is disposed within the central bore of the shaft on order to direct a flow of cooling oil into contact with the bearing shaft. The contact of the cooling oil with the shaft allows for heat exchange between the shaft and the oil, consequently reducing the heat affecting the bearing structure.

However, in prior art bearing structures, the cooling tube is formed as a constant diameter tube positioned within the bore of the bearing shaft and having a single discharge aperture for the cooling oil located within the bore. In this configuration, the amount of heat exchange that occurs between the cooling oil and the shaft is insufficient to counteract the lower thermal conductivity of steel, such that refractory metals are required for the construction of the bearing shaft in order to withstand the temperatures created when the bearing structure is in operation.

Therefore, it is desirable to develop a structure and method for the formation and operation of a bearing structure for an x-ray tube with an improved cooling structure to enable the use of low cost materials for the shaft to significantly improves heat transfer out of the bearing structure to minimize the thermal gradients and resulting non-uniform bearing deflections in the structure.

BRIEF DESCRIPTION OF THE INVENTION

In the present invention a liquid metal or spiral groove bearing structure for an x-ray tube and associated process for manufacturing the bearing structure is provided that includes a bearing shaft rotatably disposed in a bearing housing or shell. The shell includes a thrust seal engaged with a sleeve to maintain coaxiality for the rotating liquid metal seal formed in the shell about the shaft. The shaft has a bore for the introduction of a cooling fluid into the bearing assembly in which is disposed a cooling tube. The cooling tube includes turbulence-inducing features to increase the turbulence of the cooling fluid flowing through the cooling tube, consequently enhancing the heat exchange between the cooling fluid and the shaft. This maximizes the heat transfer from the shaft to the oil, allowing materials with lower thermal conductivities, such as non-refractory materials, to be used to form the bearing shaft and shell.

In one exemplary embodiment of the invention, a bearing assembly includes a shell, a shaft defining a bore therein and rotatably disposed within the shell; and a cooling tube disposed within the bore of the shaft, the cooling tube including at least one turbulence-inducing feature.

In another exemplary embodiment of the invention, An x-ray tube includes a frame defining an enclosure, a cathode assembly disposed in the enclosure and an anode assembly disposed in the enclosure spaced from the cathode assembly, wherein the anode assembly includes a sleeve, a shaft rotatably disposed within the sleeve and defining a bore therein, a cooling tube coaxially disposed within the bore in the shaft, the cooling tube including at least one turbulence-inducing feature thereon and an anode target operably connected to the sleeve.

In an exemplary embodiment of the method of the invention, a method for forming a bearing assembly for use in an x-ray tube, the method includes the steps of providing a cooling tube including at least one turbulence-inducing feature thereon, positioning the cooling tube coaxially within a defined within a shaft and securing the shaft within a shell.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION OF THE INVENTION

Figure 1:
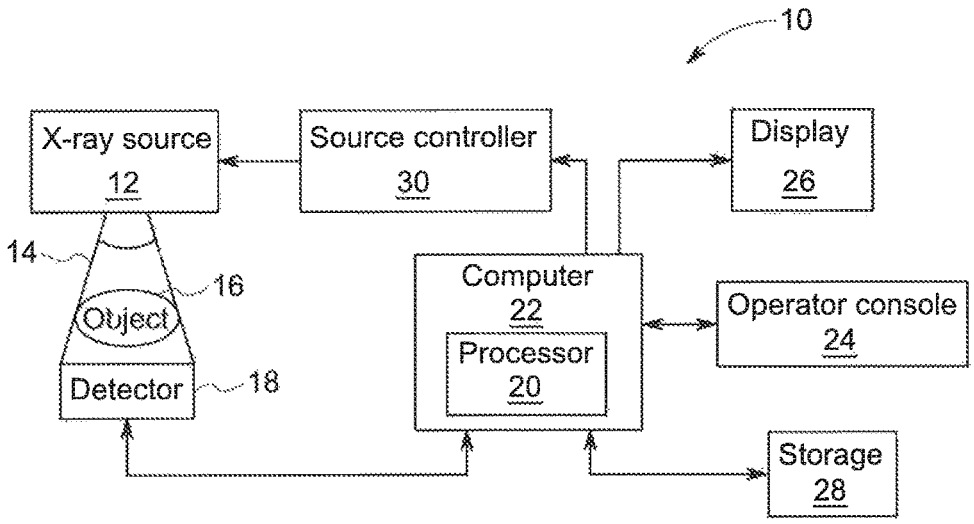
FIG. 1 is a block diagram of an imaging system incorporating exemplary embodiments of the invention.

FIG. 1 is a block diagram of an embodiment of an imaging system 10 designed both to acquire original image data and to process the image data for display and/or analysis in accordance with embodiments of the invention. It will be appreciated by those skilled in the art that various embodiments of the invention are applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from the invention. The following discussion of x-ray system 10 is merely an example of one such implementation and is not intended to be limiting in terms of modality.

As shown in FIG. 1, imaging system 10 includes an x-ray tube or source 12 configured to project a beam of x-rays 14 through an object 16. Object 16 may include a human subject, pieces of baggage, or other objects desired to be scanned. X-ray source 12 may be conventional x-ray tubes producing x-rays 14 having a spectrum of energies that range, typically, from thirty (30) keV to two hundred (200) keV. The x-rays 14 pass through object 16 and, after being attenuated, impinge upon a detector assembly 18. Each detector module in detector assembly 18 produces an analog electrical signal that represents the intensity of an impinging x-ray beam, and hence the attenuated beam, as it passes through the object 16. In one embodiment, detector assembly 18 is a scintillation based detector assembly, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Figure 2:
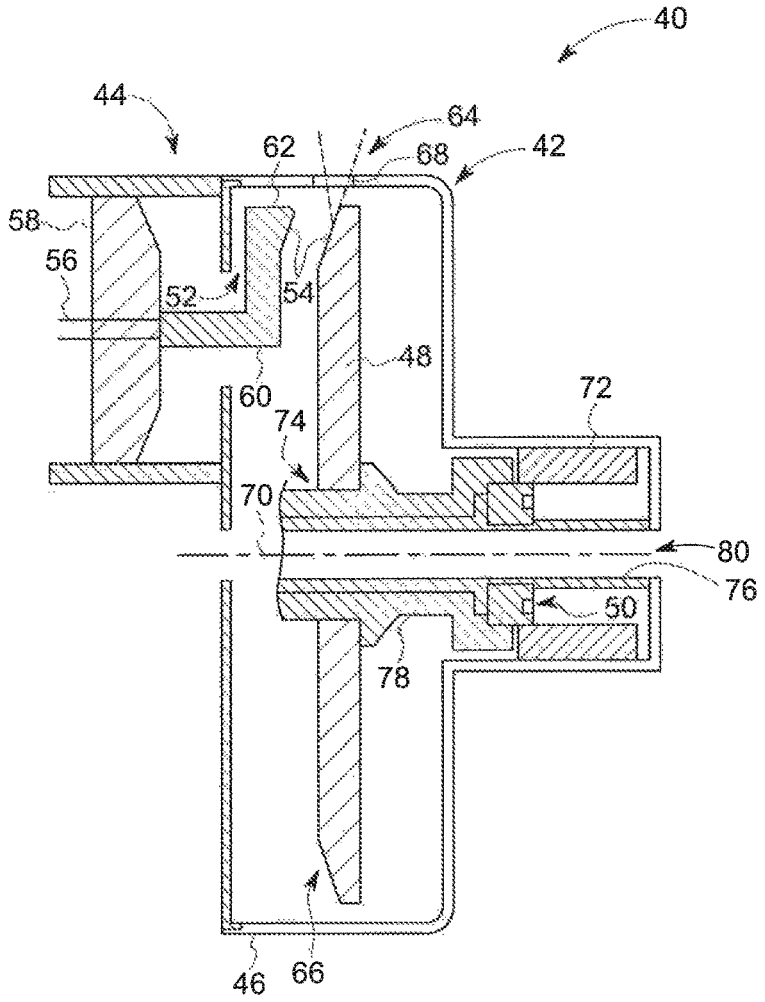
FIG. 2 is a cross-sectional view of a portion of an x-ray tube according to an exemplary embodiment of the invention and usable with the system illustrated in FIG. 1.

FIG. 2 illustrates a cross-sectional view of an x-ray source 12 incorporating embodiments of the invention. In the illustrated embodiment, x-ray source 12 is formed of an x-ray tube 40 that includes an anode assembly 42 and a cathode assembly 44. X-ray tube 40 is supported by the anode and cathode assemblies 42, 44 within an envelope or frame 46, which houses a target or anode 48, a bearing assembly 50, and a cathode 52. Frame 46 defines an area of relatively low pressure (e.g., a vacuum) 30 compared to ambient, in which high voltages may be present. Frame 46 may be positioned within a casing (not shown) filled with a cooling medium, such as oil, that may also provide high voltage insulation. While the target and anode are described above as being a common component of x-ray tube 40, the target and anode may be separate components in alternative x-ray tube embodiments.

In operation, an electron beam 54 is produced by cathode assembly 44. In particular, cathode 52 receives one or more electrical signals via a series of electrical leads 56. The electrical signals may be timing/control signals that cause cathode 52 to emit electron beam 54 at one or more energies and at one or more frequencies. The electrical signals may also at least partially control the potential between cathode 52 and anode 48. Cathode 52 includes a central insulating shell 58 from which a mask 60 extends. Mask 60 encloses electrical leads 56, which extend to a cathode cup 62 mounted at the end of mask 60. In some embodiments, cathode cup 62 serves as an electrostatic lens that focuses electrons emitted from a thermionic filament within cathode cup 62 to form electron beam 54.

X-rays 64 are produced when high-speed electrons of electron beam 54 are suddenly decelerated when directed from the cathode 52 to a target or focal surface 66 formed on target 48 via a potential difference therebetween of, for example, sixty (60) thousand volts or more in the case of CT applications. The x-rays 64 are emitted through a radiation emission passage 68 formed in frame 46 toward a detector array, such as detector 18 of FIG. 1.

Anode assembly 42 includes a rotor 72 and a stator (not shown) located outside x-ray source 40 and partially surrounding rotor 72 for causing rotation of anode 48 during operation. Target 48 is supported in rotation by a bearing assembly 50, which, when rotated, also causes target 48 to rotate about the centerline 70. As shown, target 48 has a generally annular shape, such as a disk, and an annular opening 74 in the center thereof for receiving bearing assembly 50.

Target 48 may be manufactured to include a number of metals or composites, such as tungsten, molybdenum, or any material that contributes to Bermsstrahlung (i.e., deceleration radiation) when bombarded with electrodes. Target or focal surface 66 of target 48 may be selected to have a relatively high refractory value so as to withstand the heat generated by electrons impacting target 48. Further, the space between cathode assembly 44 and target 48 may be evacuated in order to minimize electron collisions with other atoms and to maximize an electric potential.

To avoid overheating of the target 48 when bombarded by the electrons, rotor 72 rotates target 48 at a high rate of speed (e.g., 90 to 250 Hz) about a centerline 70. In addition to the rotation of target 48 within x-ray tube volume 46, in a CT application, the x-ray source 40 as a whole is caused to rotate about an object, such as object 16 of imaging system 10 in FIG. 1, at rates of typically 1 Hz or faster.

Bearing assembly 50 can be formed as necessary, such with a number of suitable ball bearings (not shown), but in the illustrated exemplary embodiment comprises a liquid lubricated or self-acting bearing having adequate load-bearing capability and acceptable acoustic noise levels for operation within imaging system 10 of FIG. 1. As used herein, the terms "self-acting" and "self-lubricating" mean that the bearing lubricant remains distributed on the surfaces of the bearing due to the relative motion of the bearing components and absent an external pump.

In general, bearing assembly 50 includes a stationary portion, such as center shaft 76, and a rotating portion, such as shell 78 to which the target 48 is attached. While center shaft 76 is described with respect to FIG. 2 as the stationary portion of bearing assembly 50 and shell 78 is described as the rotating portion of bearing assembly 50, embodiments of the present invention are also applicable to embodiments wherein center shaft 76 is a rotary shaft and shell 78 is a stationary component. In such a configuration, target 48 would rotate as center shaft 76 rotates.

Center shaft 76 can be formed of a refractory metal or a non-refractory metal, such as an iron alloy, and includes a cavity, bore or coolant flow path 80 though which a coolant/cooling fluid 82 (FIGS. 3-4), such as oil, flows to cool bearing assembly 50. As such, coolant 82 enables heat generated from target 48 of x-ray source 40 (FIG. 2) to be extracted therefrom and transferred external to x-ray source 40. In straddle mounted x-ray tube configurations, coolant flow path 80 extends along a longitudinal length of x-ray source 40. In alternative embodiments, bore 80 may extend through only a portion of x-ray source 40, such as in configurations where x-ray source 40 is cantilevered when placed in an imaging system.

Figure 3:
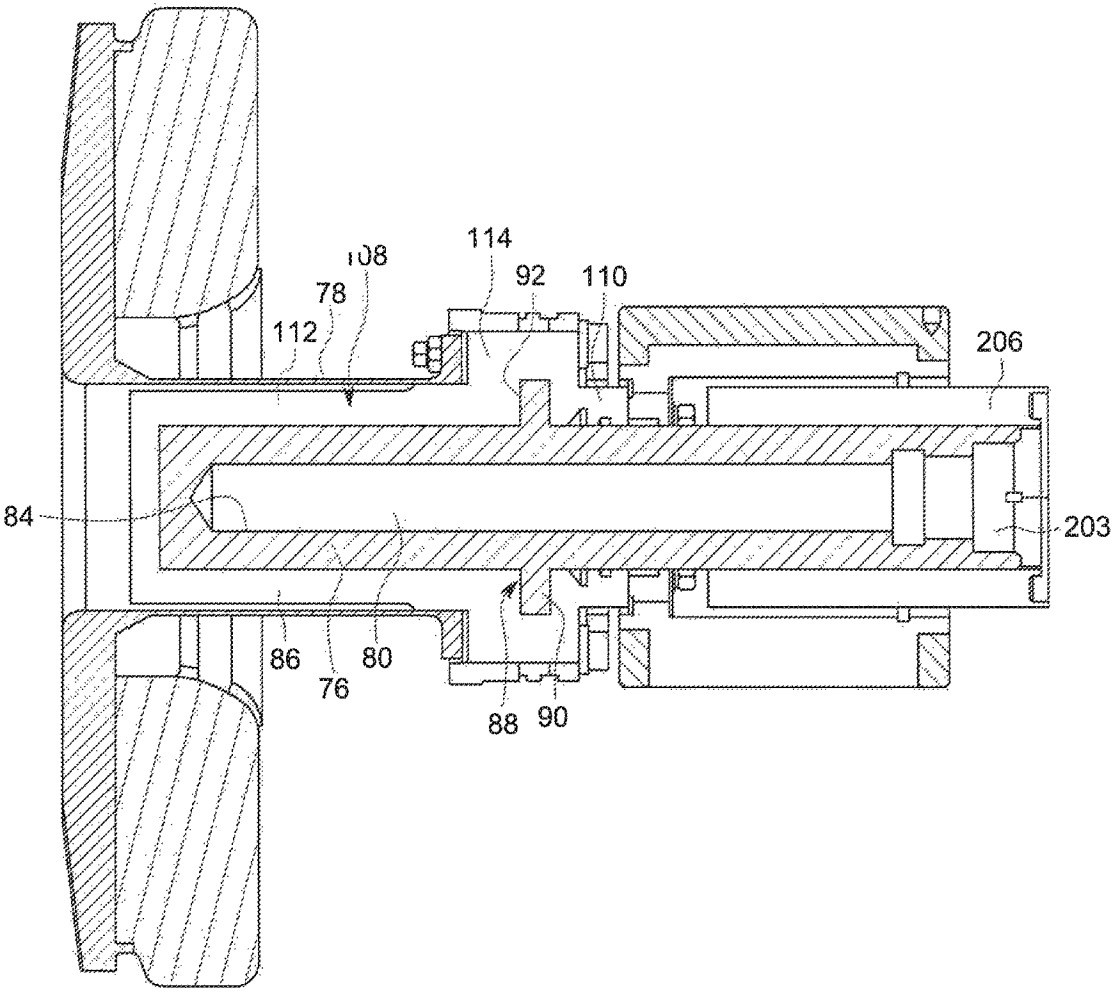
FIG. 3 is a cross-sectional side plan view of a bearing structure of an x-ray tube in accordance with an exemplary embodiment of the invention.

Referring now to FIG. 3, a cross-sectional view of a portion of bearing assembly or structure 50 is shown according to an embodiment of the invention. Bearing assembly 50 includes a center shaft 76 positioned within shell 78, which is configured to support an anode (not shown), such as target 48 of FIG. 2. A lubricant 84 is positioned in a gap 86 formed between center shaft 76 and shell 78. In embodiments of the invention, lubricant 84 is a metal or metallic alloy that exists in a liquid state at operating temperature of bearing assembly 50.

The lubricating fluid 84 flowing between the rotating and stationary components of the bearing assembly or structure 50 may include a variety of individual fluids as well as mixtures of fluids. For example, multiple liquid metals and liquid metal alloys may be used as the lubricating fluid, such as an indium gallium alloy. More generally, fluids with relatively low vapor pressures that are resistant to evaporation in vacuum-level pressures of the x-ray tube may be used. In the present context, low vapor pressures may generally be in the range of $1\times10^{-5}$ Torr. In other words, fluids that are stable in vacuums are desirable for use in x-ray tube systems so as to not adversely affect the established vacuum during operation of the system. In the present disclosure, lubricant 84 may be gallium or a gallium alloy as non-limiting examples.

In the embodiment illustrated in FIG. 3, center shaft 76 of bearing assembly 50 is a stationary component and shell 78 is a rotatable component constructed to rotate about center shaft 76. However, one skilled in the art will recognize the inventive concepts described herein are applicable to alternative bearing configurations. As one example, bearing assembly 50 may instead include a stationary outer component and a rotating center shaft comprising a target attached thereto. As another example, bearing assembly 50 may be a "straddle" bearing that is configured to support a target between a first and a second liquid metal bearing. In other words, embodiments of this invention may be incorporated into any bearing configuration utilizing a liquid lubricated bearing to support an anode or target. Such configurations may include a stationary center shaft and a rotatable outer shaft, and vice versa. Further, one skilled in the art will recognize that such applications need not be limited to x-ray tubes, but may be applied to any configuration having a rotating component in a vacuum, the rotating component being supported by a liquid lubricated bearing. Thus, the embodiments of the invention disclosed herein are applicable to any bearing configuration having a rotatable component and a stationary component, and a liquid lubricant therebetween, regardless of configuration or application.

As illustrated in FIG. 3, center shaft 76 of bearing assembly 50 includes a thrust bearing portion 88 comprising a radial projection 90 that extends from center shaft 76 and is positioned in a radial cavity 92 of shell 78. Radial projection 90 limits axial motion of sleeve 78 relative to center shaft 76, and, as illustrated, lubricant 84 is also included between radial projection 90 and shell 78. Radial projection 90 need not be limited in axial length, but may be extended in axial length to provide additional mechanical support of components.

Bearing assembly or structure 50 may be referred to as a spiral groove bearing (SGB) due to the patterning of grooves along the various surfaces of the bearing. In some examples, the spiral groove may be formed from a logarithmic spiral shape. The spiral groove bearing may also be equivalently referred to as a fluid dynamic bearing and liquid bearing as well. In such spiral groove bearings, ways to contain the liquid lubricant 84 may be categorized in two general methods. The first includes providing physical barriers near the ends of the bearing where shaft seals would be placed in other applications. Rubber or other types of shaft seals in the presence of the vacuum inside the x-ray tube may function improperly, degrade quickly, and/or destroy the pressure inside the x-ray tube. For similar reasons, o-rings, grease, or other conventional means for aiding in rotational lubrication between two components may be undesirable because of the vacuum in the x-ray lube. Greases and other lubricants with lower vapor pressure than liquid metals may vaporize and destroy the vacuum. In some examples, physical walls of different shapes and sizes may be placed at different angles to capture the lubricant to reduce leakage through the bearing.

The second general method includes utilizing the capillary forces of the lubricant, wherein the small gap between two opposing bearing surfaces wets the fluid to retain the fluid within the gap. In other words, the anti-wetting properties of the surface (via texturing, coating, or both) aids in preventing the lubricant from flowing in between the small gaps. In some examples, the surfaces are coated and/or textured to be more wetted such that the lubricant clings in the small gap to reduce lubricant moving through the gap. In other examples, the surfaces are coated and/or textured to be more anti-wetting such that the lubricant is pushed away from the small gaps near the ends of the bearing assembly. In this context, the small gap may be in the range of 30-120 microns.

Operation of liquid bearings in x-ray tube systems, such as bearing assembly 50 of FIGS. 2 and 3, may be at least partially dependent on a tradeoff between load carrying capacity and fluid pumping force. In some examples, the load carrying capacity and fluid pumping force are inversely proportional and directly related to geometry of the bearing grooves. For example, given a substantially constant rotational speed of the liquid bearing, deeper grooves may provide a higher pumping force, while the increased clearance between the shaft and sleeve can reduce the load carrying ability of the bearing. Pumping force may be utilized to contain the lubrication fluid and anti-wetting coatings may be applied to sealing surfaces to further assist in containing the lubrication fluid.

The lubricating fluid in between bearing surfaces such as the shaft and sleeve are rotating relative to each other. As such, the lubricating fluid is moved in a number of ways, including but not limited to, shearing, wedging, and squeezing, thereby creating pressures to lift and separate the shaft and sleeve from each other. This effect enables the liquid bearing to function and provide low-friction movement between the shaft and sleeve. In other words, shearing of the lubricating fluid imparts energy into the fluid which cases the fluid to pump, wherein the pumping action into the gap between the shaft and sleeve is how the liquid bearing functions. Energy transfer from the surfaces to the fluid enables bearing functionality. In application, in the context of the x-ray tube, wetting between some bearing surfaces and the lubricating fluid allows shearing to impact energy to the fluid.

In the exemplary embodiment of the invention illustrated in FIG. 3 the shell 78 is formed with a 2-piece construction including a sleeve 108 and a thrust seal 110. In the exemplary construction of the sleeve shown in FIG. 3, the sleeve 108 is formed of a material that is low cost, with good machinability, good galling/wear characteristics, and good weldability. In an exemplary embodiment of the invention, the material forming the sleeve 108 is a non-refractory metal, such as an iron alloy, including stainless steel or tool carbon steel, among others. The sleeve 108 is formed as a single piece of the selected material, with a closed cylindrical cap portion 112 at one end and an open seating portion 114 at the opposite end. The seating portion 114 is integrally formed with the cap portion 112 to form a unitary structure for the sleeve 108, and has a diameter greater than that of the cap portion 112, such that the seating portion 114 extends radially outwardly from the cap portion 112 for engagement with the thrust seal 110 to rotationally secure the shell 78 to the shaft 76.

Figure 4:
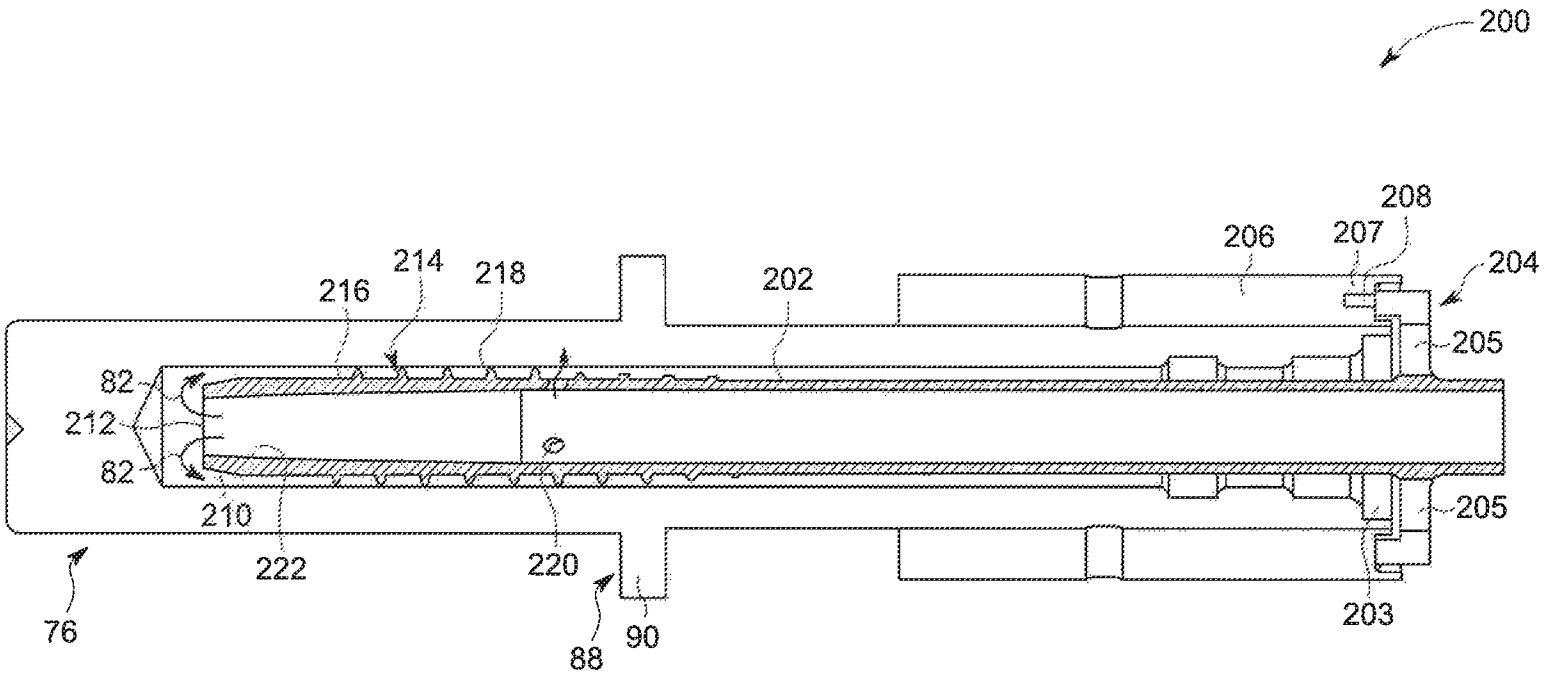
FIG. 4 is a cross-sectional view of the shaft of the bearing structure of FIG. 3 including an improved cooling tube in accordance with an exemplary embodiment of the invention.

Looking now at FIGS. 3-4, in the illustrated exemplary embodiment the shaft 76 includes a cooling tube 200 disposed coaxially within the bore 80 of the shaft 76. The tube 200 is constructed to create and provide multiple impingement points utilizing a non-uniform cross-section for the cooling tube 200 to maximize heat transfer coefficient for a given surface area in steel spiral groove bearings used in x-ray tubes. The cooling tube 200 includes a channel 202 that extends along the interior of the bore 80 and a retaining ring 204 that is positioned over the open end 203 of the bore 80 and secured to a mounting cylinder 206 disposed around the shaft 76. The mounting cylinder 206 includes a number of mounting bores 207 adjacent the open end 203 of the bore 80 and which receive mounting pins 208 disposed on the retaining ring 204 and extending inwardly parallel to the channel 202. The pins 208 can be affixed within the bores 207 in any suitable manner, such as by adhering or welding the pins 208 within the bores 207, among others.

The cooling tube 200 functions to direct the coolant 82 into the bore 80 of the shaft 76 through the channel 202. Upon exiting the channel 202 adjacent the closed end 210 of the bore 80, the coolant 82 comes into contact with the internal diameter of the bore 80 of the shaft 76. Heat from the shaft 76 is exchanged into the cooling fluid 82 upon contact of the coolant 82 with the shaft 76 and the heated cooling fluid 82 is withdrawn from the bore 80 around the channel 202 via exit apertures 205 formed in the retaining ring 204 adjacent the channel 202.

In order to maximize the thermal contact of the coolant 82 with the surfaces of the bore 80, the channel 202 of the cooling tube 200 is formed with a number of turbulence-inducing features that can be utilized individually or in combination with one another to maximize heat transfer coefficient for a given surface area in steel spiral groove bearings used in x-ray tubes.

Figure 5:
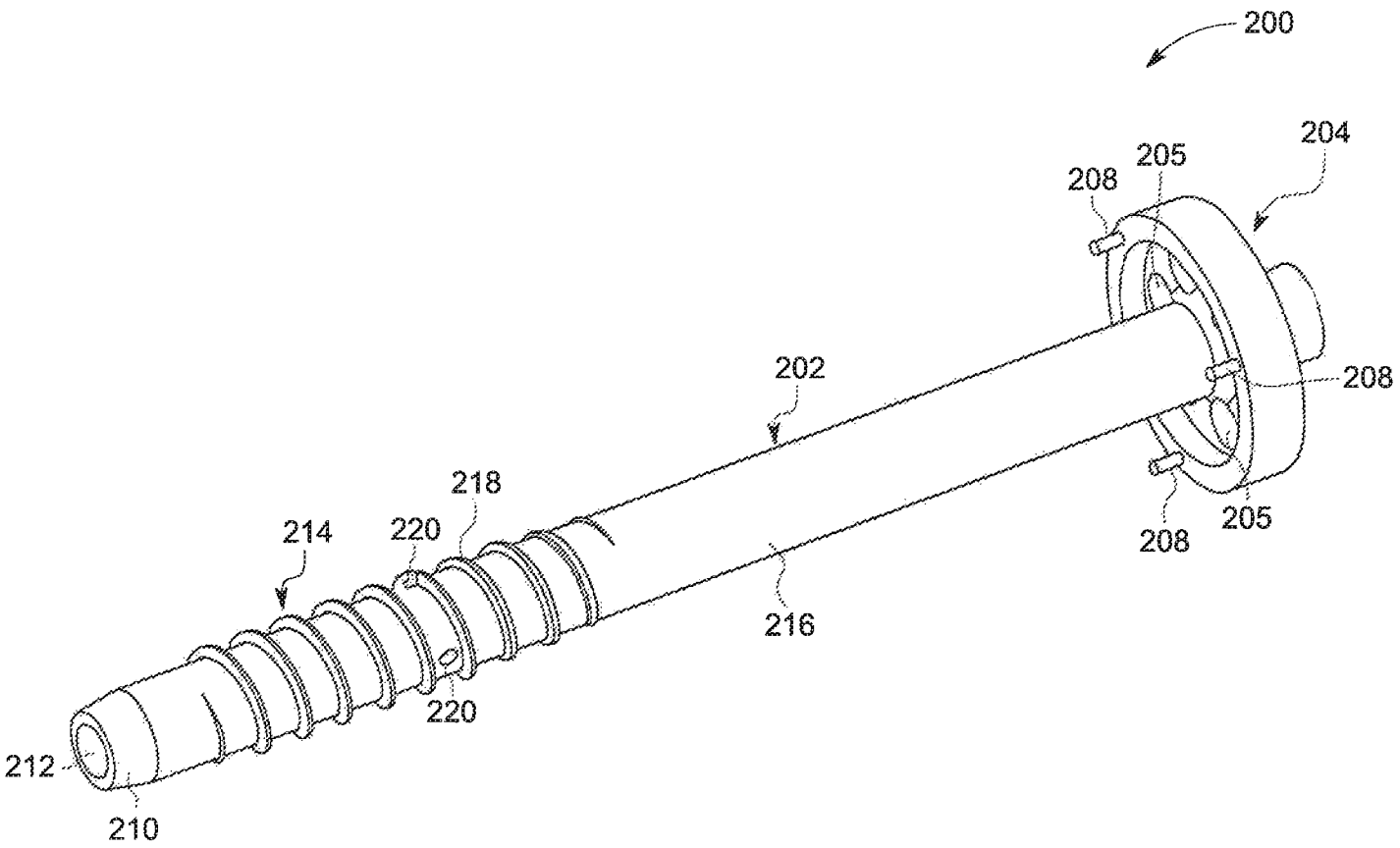
FIG. 5 is an isometric view of the cooling tube of FIG. 4 in accordance with an exemplary embodiment of the invention.
Figure 6:
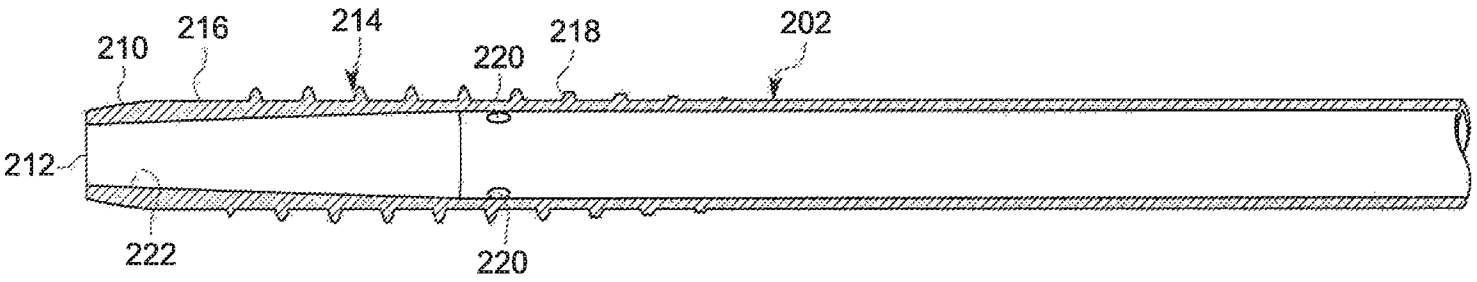
FIG. 6 is a cross-sectional view of the cooling tube of FIG. 5

In the illustrated exemplary embodiment of FIGS. 4-6, the channel 202 includes a chamfer or front taper 210 at the open end 212 of the channel 202 located opposite the retaining ring 204. The chamfer/taper 210 on the exterior surface 216 of the channel 202 functions to direct the coolant 82 exiting the open end 212 of the channel 202 outwardly against the surfaces of the bore 80, increasing the thermal contact of the coolant 82 with the shaft 76.

In addition, the channel 202 also includes one or more protrusions or vanes 214 disposed on the exterior surface 216 of the channel 202 adjacent or spaced from the open end 212. The vanes 214 can have any desired configuration that extends radially outwardly from the exterior surface 216 of the channel 202 to create turbulence in the flow of the cooling fluid 82 passing between the channel 202 and the bore 80. In the illustrated exemplary embodiment of FIGS. 4-6, the vanes 214 are formed as a helical spiral vane 218 that winds around the exterior surface 216 of the channel 202. The vanes 214/218 operate to deflect the cooling fluid 82 striking the vanes 214/216 outwardly towards the interior surface of the bore 80, further increasing the thermal contact of the cooling fluid 82 with the bore 80. The exemplary embodiment including the helical vane 218 also imparts a swirling motion to the flow of the cooling fluid 82 as it moves bore 80 between the open end 212 of the channel 202 and the exit apertures 206 in the retaining ring 204. In addition, the size of the vanes 214/216 can vary across the exterior surface 216 in order to vary the amount of turbulence created by the vanes 214/218 at specified locations along the channel 202.

To further assist in increasing the thermal contact of the cooling fluid 82 with the surfaces of the bore 80, the channel 202 can additionally include a number of spray jet openings 220 formed in the channel 202. The openings 220 can be disposed at any location along the channel 202 and in the exemplary embodiment of FIGS. 4-6 are located at positions to maximize the thermal contact of the cooling fluid 82 with the hottest locations of the bearing shaft 76. The openings 220 enable amounts of the cooling fluid 82 to be dispensed from the channel 202 prior to reaching the open end 212. The pressure of the fluid 82 moving through the channel 202 causes the fluid 82 exiting the channel 202 through the openings 220 to spray outwardly from the openings 220, creating turbulence within the cooling fluid 82 flowing between the bore 80 and the channel 202 in addition to that being created by the vanes 214/218.

Looking now at the exemplary embodiment of FIGS. 4 and 6, the channel 202 may also include an internal taper 222 adjacent the open end 212 of the channel 202. The internal taper 222 can extend from the open end 212 upstream to a location adjacent the openings 220 and can function to impart additional speed to the flow of cooling fluid 82 through the channel 202 as a result of the diameter reduction of the channel 202 caused by the internal taper 222.

With a cooling tube 200 having one or more of these features, the tube 200 minimizes the thermal gradients and non-uniform bearing growth by maximizing heat transfer coefficient through the impingement jets/openings 220 and turbulence from the vanes 214/216, while minimizing overall flow rate and pressure drop of the cooling fluid 82. As a result, steel can be used as a material for the bearing shaft 76 and shell 78 without having to increase the bearing size, or increase the size of any heat exchanger (not shown) to remove additional heat from the bearing assembly 50. This, in turn, minimizes bearing friction and heat exchanger pump power consumption. Further, the bearing shaft 76 and shell 78 formed of steel are a fraction of the cost of component formed from refractory metals, such as molybdenum, due to both labor and material costs, and have an increased bearing life.

Further, as the cooling tube 200 itself can be formed in any suitable manufacturing process and of any suitable material, such as a metal, including steel. In one exemplary embodiment, the tube 200 is formed of a suitable material, including, but not limited to, stainless steel, carbon steel, aluminum, plastic, or carbon fiber, among others, in an additive manufacturing process in order to closely control the size, position and materials utilized in the formation of each of the features 210, 214, 218, 220, 222 to maximize heat transfer coefficient for a given surface area in spiral groove bearings used in x-ray tubes, whether the bearings include steel components and/or components formed of other materials.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A bearing assembly comprising:

a shell;

a shaft defining a bore therein and rotatably disposed within the shell; and a cooling tube disposed within the bore of the shaft, the cooling tube including at least one turbulence-inducing feature.

2. The bearing assembly of claim 1, wherein the at least one turbulence-inducing feature is disposed on an interior of the cooling tube.

3. The bearing assembly of claim 2, wherein the cooling tube includes a channel extending into the bore of the shaft and wherein the at least one turbulence-inducing feature is an internal taper in the channel.

4. The bearing assembly of claim 1, wherein the at least one turbulence-inducing feature is disposed on an exterior of the cooling tube.

5. The bearing assembly of claim 4, wherein the at least one turbulence-inducing feature is a protrusion disposed on an exterior surface of the cooling tube.

6. The bearing assembly of claim 5, wherein the protrusion has a varying height on the exterior surface of the cooling tube.

7. The bearing assembly of claim 5, wherein the protrusion disposed on the exterior surface of the cooling tube is a vane.

8. The bearing assembly of claim 7, wherein the vane is a helical spiral vane.

9. The bearing assembly of claim 4, wherein the at least one turbulence-inducing feature is a chamfer disposed on an exterior surface of the cooling tube.

10. The bearing assembly of claim 1, wherein the least one turbulence-inducing feature is at least one spray opening formed in the cooling tube.

11. The earing assembly of claim 1, wherein the least one turbulence-inducing feature is selected form the group consisting of: at least one spray opening formed in the cooling tube, a chamfer disposed on an exterior surface of the cooling tube, a protrusion disposed on an exterior surface of the cooling tube, an internal taper in the cooling tube, and combinations thereof.

12. The bearing assembly of claim 1, wherein the shaft is formed of a non-refractory metal.

13. The bearing assembly of claim 12, wherein the non-refractory metal is selected from a stainless steel or a carbon tool steel.

14. The bearing assembly of claim 12, wherein the shell is formed of a non-refractory metal.

15. A method for forming a bearing assembly for use in an x-ray tube, the method comprising the steps of:

providing a cooling tube including at least one turbulence-inducing feature thereon;

positioning the cooling tube coaxially within a defined within a shaft; and securing the shaft within a shell.

16. The method of claim 15, wherein the step of providing the cooling tube comprises constructing the cooling tube in an additive manufacturing process.

17. The method of claim 15, wherein the shaft is formed of a non-refractory metal.

18. An x-ray tube comprising:

a cathode assembly; and an anode assembly spaced from the cathode assembly, wherein the anode assembly comprises:

a sleeve;

a shaft rotatably disposed within the sleeve and defining a bore therein;

a cooling tube coaxially disposed within the bore in the shaft, the cooling tube including at least one turbulence-inducing feature thereon; and an anode target operably connected to the sleeve.

19. The x-ray tube of claim 18 wherein the shaft is formed of a non-refractory material.

20. The x-ray tube of claim 18 wherein the at least one turbulence-inducing feature is selected form the group consisting of: at least one spray opening formed in the cooling tube, a chamfer disposed on an exterior surface of the cooling tube, a protrusion disposed on an exterior surface of the cooling tube, an internal taper in the cooling tube, and combinations thereof.

* * * * *